US005733403A

United States Patent [19]

Morley

[11] Patent Number: 5,733,403

[45] Date of Patent: Mar. 31, 1998

[54] PRODUCT PACKAGING MATERIAL AND ITS MANUFACTURING METHOD

[75] Inventor: Timothy Corben Morley, Birmingham, England

[73] Assignee: Aston Packaging Limited, Aston, England

[21] Appl. No.: 553,280

[22] PCT Filed: May 26, 1994

[86] PCT No.: PCT/GB94/01146

§ 371 Date: Nov. 28, 1995

§ 102(e) Date: Nov. 28, 1995

[87] PCT Pub. No.: WO94/27813

PCT Pub. Date: Dec. 8, 1994

[30] Foreign Application Priority Data

May 28, 1993 [GB] United Kingdom ..... 9311075

[51] Int. Cl.[6] ..... B31F 1/22

[52] U.S. Cl. ..... 156/207; 156/193; 156/194; 156/196; 156/205; 264/287; 493/407; 493/463; 493/464; 493/967

[58] Field of Search ..... 428/182, 184, 428/906; 493/967, 340, 405, 407, 463, 464; 156/207, 210, 160, 193, 194, 196, 205, 219, 220; 264/148, 287; 53/396

[56] References Cited

U.S. PATENT DOCUMENTS

| | | | |
|---|---|---|---|
| 479,999 | 8/1892 | Thompson | 428/184 |
| 2,314,876 | 3/1943 | Greene | 428/184 |
| 3,616,135 | 10/1971 | Tesainer et al. | 428/182 |

*Primary Examiner*—Donald Loney
*Attorney, Agent, or Firm*—Albert O. Cota

[57] ABSTRACT

This invention relates to a product packaging material and method, and in particular to a product packaging material (27) formed from a length of rolled corrugated paper (20) and a method of manufacture therefor. There is provided a packaging material comprising corrugated paper (20), the corrugated paper including non-sinusoidal corrugations (16, 18, 72). There is also provided a method of making a packaging material of multi-layer corrugated paper (27) including the steps of forming corrugated paper (20) having a sheet with sinusoidal corrugations (42), and compressing the sheet to destroy the sinusoidal form of at least some of the corrugations.

8 Claims, 3 Drawing Sheets

PRODUCT PACKAGING MATERIAL AND ITS MANUFACTURING METHOD

FIELD OF THE INVENTION

This invention relates to a product packaging material and method, and in particular to a product packaging material formed from a length of rolled corrugated paper and a method of manufacture therefor.

BACKGROUND TO THE INVENTION

Many products need to be stored and/or transported in packaging materials selected to provide impact cushioning.

Environmental concerns today are resulting in the buyers, specifiers and/or designers of packaging products demanding cushioning materials that have as small an effect as possible on diminishing fossil fuel reserves and on increasingly overloaded landfill waste disposal sites; consequently materials manufactured from recycled waste materials, and which are themselves recyclable, are increasingly demanded.

Corrugated paper meets the requirement for a recyclable packaging material, which often can also be re-used. Typically "single-faced" corrugated paper is used i.e. with a planar paper sheet having affixed to one side a sinusoidal corrugated sheet. Corrugated board is also available i.e. with the sinusoidal corrugated sheet sandwiched between two planar sheets. Often the corrugated paper is used in multi-layer form. Corrugated paper is not however usually recommended for cushioning applications such as may be required for the packaging of highly fragile products such as certain optical instruments and computer floppy disc drives.

DISCLOSURE OF THE PRIOR ART

Polyethylene foams are known for packaging optical equipment and computer floppy disc drives. This material is however petroleum based, using scarce and unrenewable resources. After use it is difficult to discard in a manner of little detriment to the environment; often it is simply buried.

Paper, being wood based, can be recycled. Corrugated paper is usually made from recycled waste paper, and is also itself recyclable. The corrugated paper can be formed into a variety of suitable shapes; the required form imposed by the manufacturer can be retained (at least until the formed product is ready for use by the packager) by the use of a suitable adhesive.

SUMMARY OF THE INVENTION

The applicants have sought to modify the properties of corrugated paper, single-faced or board, and when in multi-layer form, to permit its use as a material with increased cushioning properties.

As one feature of the invention the applicants therefore provide a modified corrugated paper, in which the corrugations are no longer sinusoidal. Usefully the corrugations are of a crushed or tilted form, though they are still present i.e. the "crushing" is not so severe as to flatten the corrugations in the finished (marketed) material, but is sufficiently severe to remove (destroy) the inherent strength of the sinusoidal form of the corrugations.

The applicants developed the invention from the realisation that the internal fibrous structure of the material from which the corrugated paper is formed provides the resilience needed for restoring the corrugated paper after an impact, so that it is ready to withstand another impact; yet recognised also that the sinusoidal form into which the material is traditionally corrugated has too high a deformation modulus i.e. it does not yield or deform sufficiently under low force applications, and so acts effectively as a "solid wall" against which a packaged product is required to "bounce", rather than as a cushion able to absorb product movements (and being resilient also to return to or nearly to its original condition after absorbing an impact).

Delicate instruments in particular need to be gently cushioned, with the packaging material (a) of a structure to yield to absorb an impact and (b) of a composition to return towards its original condition.

Thus according to a further feature of the invention we provide a product packaging material comprising corrugated paper, the corrugated paper including non-sinusoidal corrugations.

According to another feature of the invention we provide a method of making a packaging material which includes the steps of forming corrugated paper having a sheet with sinusoidal corrugations, and deforming the corrugations to destroy the sinusoidal form. The corrugations can be deformed prior to the corrugated paper being formed into the shape required of the packaging material, or can be deformed after the corrugated paper has been so formed.

Conveniently the corrugated paper has the corrugated sheet adhered to a base sheet so that the separation between the corrugations is pre-determined, and then the corrugations are alternatively tilted to one side by the compressive force, or have their apices flattened.

According to yet another feature of the invention we propose a method of making a cushioning material which includes providing a corrugated sheet with non-sinusoidal corrugations, and adhering the sheet to a base sheet, whereby to provide compressed corrugated paper. If manufactured utilising conventional machinery, with this method the corrugated sheet will first be made with sinusoidal corrugations, which thereafter are deformed, as by being passed between nip rollers or placed in a press.

The applicants have found that such modified ("deformed") corrugations retain the material resilience and restoration needed for product protection against repeated impacts (as over long journeys or under other vibration conditions), but that the deformed, non-sinusoidal, corrugations deflect more readily at lower applied forces, with enhanced cushioning. Typically the packaging material will be used in multi-layer form, and so for applications with anticipated high vibration or impact loading, the packaging materials will conveniently have more than one layer of compressed corrugated paper, though a deeper corrugation can alternatively be used to provide such "thicker" packaging material.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
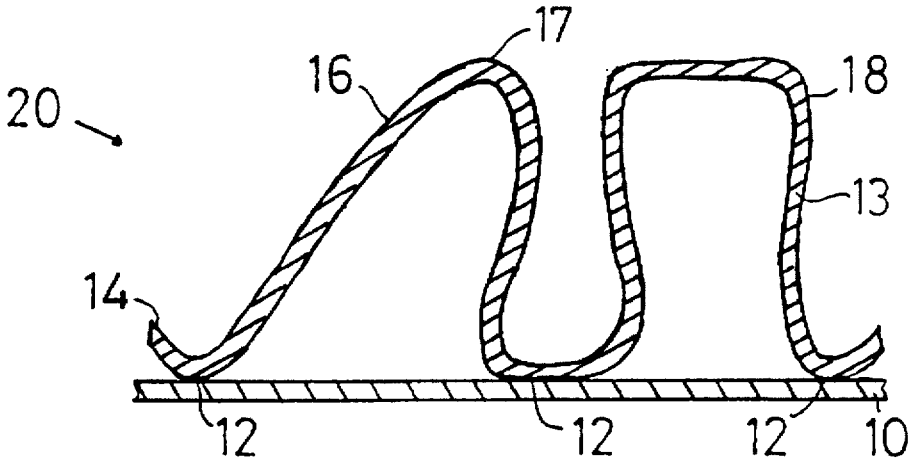
FIG. 1 is a section of part of a sheet of single-faced corrugated paper according to the invention.
Figure 4:
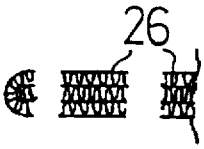
FIG. 4 is a side view of the flattened roll of FIG. 3, having been cut into blocks.

In FIG. 1, a paper-based sheet 10 is of generally planar section, and has attached thereto at positions 12, as by adhesive, a similar sheet 14 but formed into corrugations 16,18. Thus, there is provided a sheet of single-faced corrugated paper 20. In this embodiment the corrugations 16,18 have been deformed (as by the nip rollers 40 of FIG. 4), and as a result the corrugation 16 has been tilted so that its apex 17 is no longer in the median plane between the points, lines, or positions of adhesion 12, whilst the corrugation 18 has been generally crushed i.e. its apex has been flattened and its wall portions 13 deformed, and partially crushed.

In other embodiments, all of the corrugations on a single sheet are deformed similarly i.e. all of the corrugations are crushed, or all of the corrugations are tilted. In yet another embodiment, the form of the deformed corrugations is random.

In an alternative known embodiment, the apices of the corrugations can be adhered to a second planar sheet, with the corrugations sandwiched therefore between two planar sheets, to form corrugated board.

For use as a packaging or cushioning material, the corrugated paper will be wound or laminated into multi-layer form in conventional manner.

Figure 3:
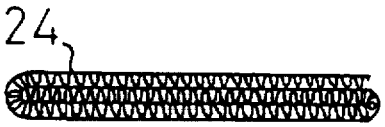
FIG. 3 is a side view of the roll of FIG. 2, having been flattened.

A single-faced sheet of corrugated paper has glue painted upon the apices of the corrugations, and is then wound (around a mandrel) upon itself to produce a wound roll 22; thereafter the roll is retained in a "forming" machine until the adhesive sets, whereby to provide the required final shape of packaging material, in this embodiment a flattened roll 24 (FIG. 3). The flattened roll 24 is then cut to length to provide one or more blocks of packaging material 26 (FIG. 4), which blocks are then compressed (as by a press 50 of FIG. 8), to deform the corrugations and produce a block 27 of packaging material (FIG. 5).

Figure 5:
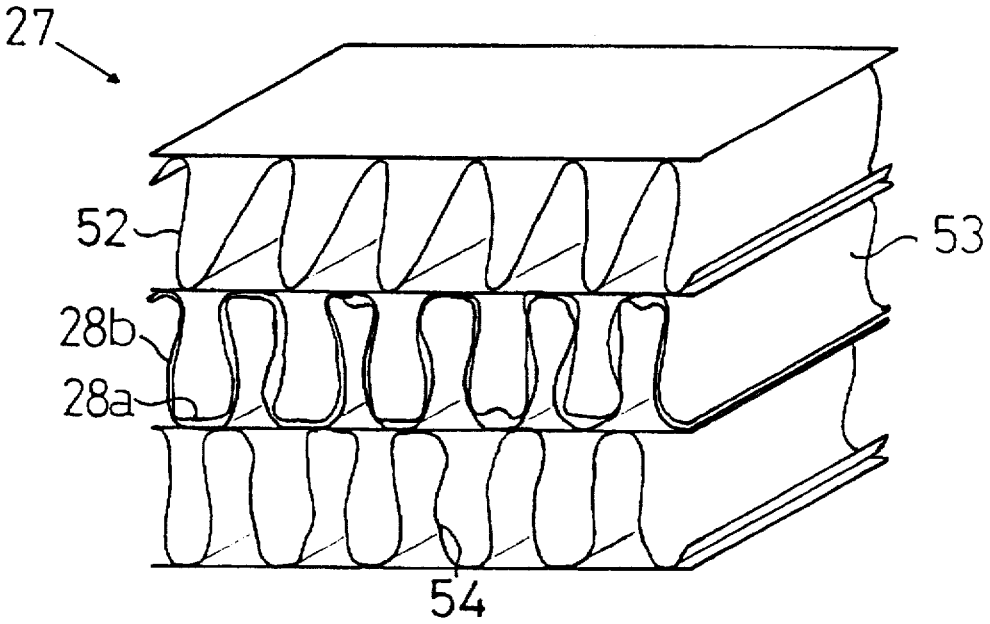
FIG. 5 is a view of a block of FIG. 4, having been compressed into a multi-layer product packaging material according to the invention.

It will be understood that since the corrugated paper is wound upon itself (in this embodiment as a double coil or winding), that the corrugations 28*a*,*b* of the innermost winding of the roll become enmeshed, i.e. as viewed in FIG. 5 the lower two sheet portions have the corrugations upwards whilst the upper two sheet portions have the corrugations downwards.

In this embodiment the roll 22 is formed into a packaging material having four layers of over-laid single-faced corrugated paper, whereby to provide the packaging material, though in other embodiments a greater or lesser number of over-laid layers can be utilised.

Figure 6:
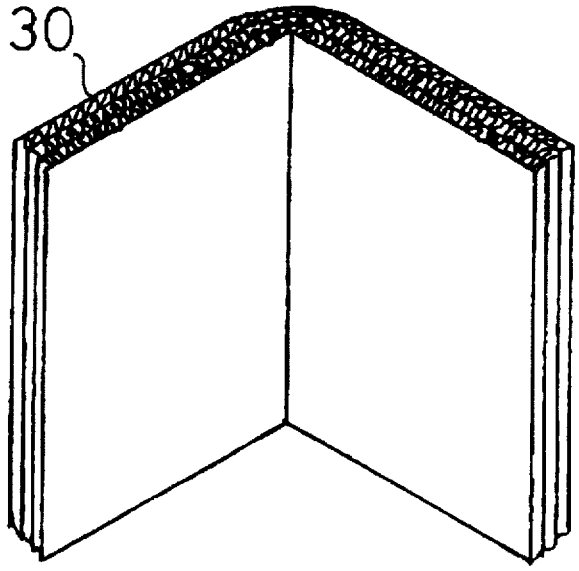
FIG. 6 is of a multi-layer packaging material, shaped to accommodate a corner edge of a product to be transported.

In the alternative embodiment of FIG. 6, the roll is formed into an "L" section corner piece 30, suitable for protecting the corners of an article to be transported. This corner piece could likewise be formed from adhering two of blocks 22 at 90° to each other.

Other suitable shapes of packaging material may be provided, either "as formed", or by combining blocks of suitable shape.

Figure 7:
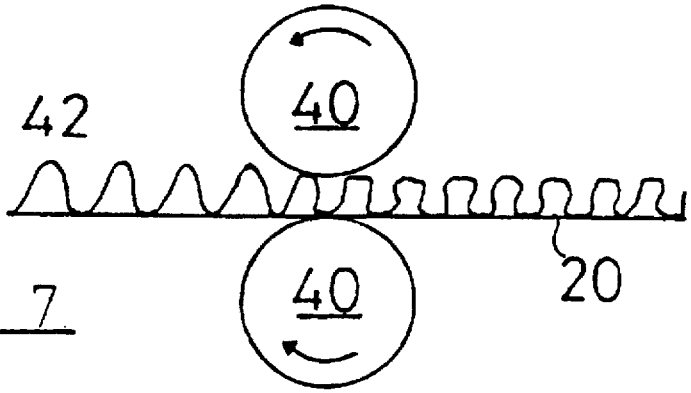
FIG. 7 is a view of a pair of nip rollers used to deform the sinusoidal corrugations of the corrugated paper.

In the embodiment of FIG. 1, the sheet is compressed i.e. the corrugations are deformed prior to forming the multi-layer packaging material. This may be achieved by a pair of nip rollers 40 as shown in FIG. 7. Thus, after the corrugated sheet 14 has been adhered to the planar sheet 10 in conventional manner, the sheet of single-faced corrugated paper 20 is passed between rollers 40, which are spaced apart by less than the height of the (undeformed) sinusoidal corrugations 42. Upon passing between the rollers 40, the corrugations become deformed, either to the crushed condition 18, or the tilted condition 16, of FIG. 1, or to a random combination of these conditions. The degree of compression can be determined by the spacing of the rollers 40, whilst the deformation of the corrugations can in part be determined by the rate of rotation of the rollers 40 relative to the permitted speed of pass of the sheet 20.

Figure 8:
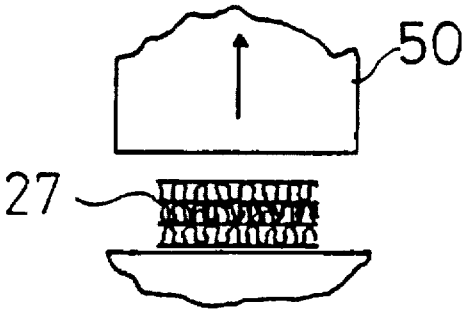
FIG. 8 is a view of a press having deformed the corrugations of a multi-layer product packaging material.

In the embodiment of FIG. 5 the corrugations have been deformed by compression only after the packaging material has been formed to shape. As shown in FIG. 8, already formed product packaging material 27 of known type is placed beneath a reciprocating press 50, shown returning from a compression step. It will be understood that prior to the engagement of the press, the corrugations in the packaging material had been sinusoidal, but after being compressed by the press, they are in the deformed condition such as that of FIG. 5.

Whilst in FIG. 5 all of the formed layers 52,53 and 54 are shown deformed, the pressure applied by press 50 is arranged preferentially to deform only the corrugations of the inner layer(s) 53 i.e. rather than the corrugations of the outer layer(s). Likewise, in a product packaging material formed from a sheet 10 of FIG. 1, it may be arranged that not all of the corrugations be defomed prior to roll winding, e.g. the portion of the corrugated sheet which will make up the outer layers of the block of packaging material is not passed through nip rollers 40, whilst the portion of the corrugated sheet which will make up the inner layers is passed through nip rollers.

Alternatively, different degrees of compression, and thus of corrugation deformation, may be applied to different portions of the sheet, as by varying the gap between the nip rollers 40 as the sheet passes therethrough, or by compressing a formed block with a curved, or otherwise non-flat, press.

The degree of compression used will affect the properties of the product packaging material. Furthermore, the thickness of the paper from which the corrugations are formed, the size and spacing of the corrugations, the number of layers of corrugated sheet used, as well as the degree of compression can all be varied to determine the properties of the finished material and packaging product.

Figure 9:
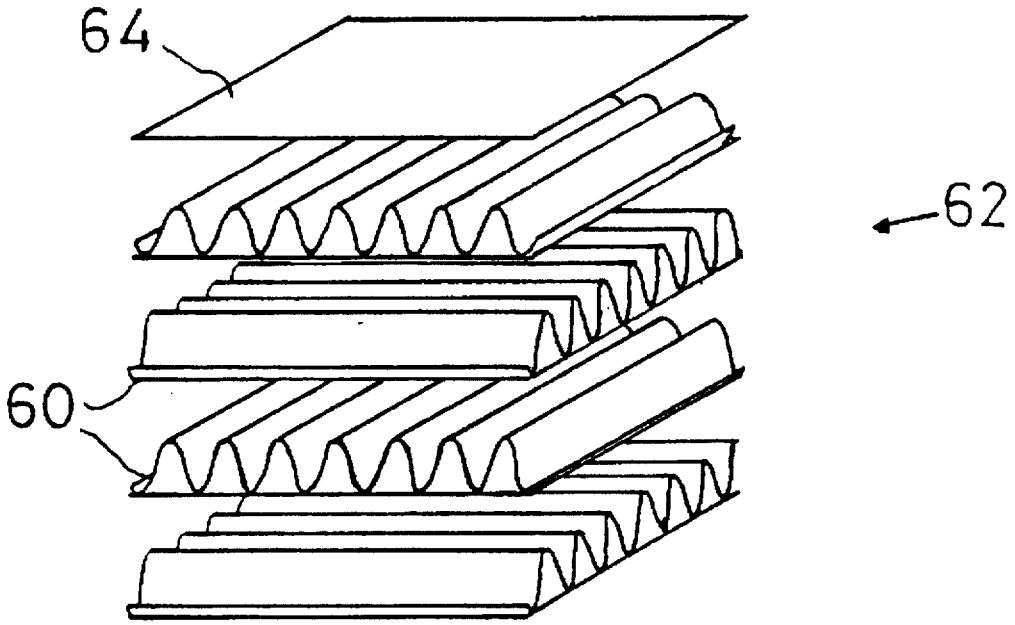
FIG. 9 is an exploded view of another embodiment of multi-layer product packaging material.

In the further alternative embodiment of FIG. 9 (exploded view), flat prepared sheets of corrugated paper 60 of predetermined size and shape are adhered together in a stack providing the multi-layer packaging material 62. In this embodiment the corrugations of adjacent pieces of corrugated paper are arranged to run perpendicular to those of adjacent layers, but in an alternative embodiment they can run parallel. It will be understood that the corrugations in this embodiment can be deformed prior to adhering the sheets into a stack (as in FIG. 1), or the packaging material 62 may be compressed, as by a press 50 of FIG. 8, after the sheets have been adhered together. A single planar sheet 64 is added to the upper layer (as viewed) of corrugations so that the product packaging piece presents a flat surface on its top and bottom surfaces, though in some situations the planar sheet 64 will not be required.

Figure 10:
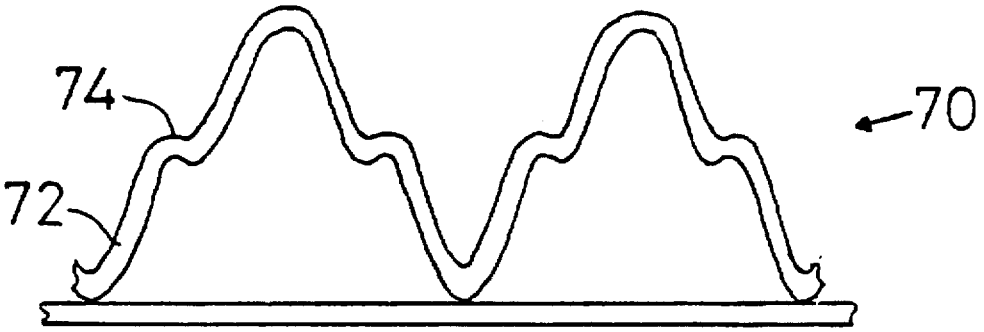
FIG. 10 is a section of part of an alternative embodiment of sheet of single-faced corrugated paper.

The sheet of corrugated paper 70 of the embodiment of FIG. 10 is produced on a non-standard corrugating roller, so that the form of the corrugated paper sheet 72 as manufactured is non-sinusoidal, and has in-built i.e. pre-formed deformations or shoulders 74, which in use act we believe to allow preferential compression of the corrugated paper if under reduced loading. Thus, the corrugated paper 70 will have a lower resistance to compression than paper with sinusoidal corrugations.

Figure 2:
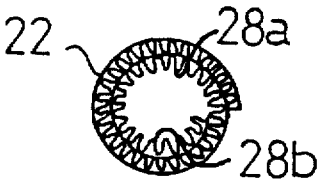
FIG. 2 is a side view of corrugated paper wound into a multi-layer roll.

The corrugated paper 70 may be formed into a packaging material by the winding process discussed in relation to FIG. 2, or by the layering process discussed in relation to FIG. 6. A packaging material so made has been found to have improved cushioning capabilities over material made with standard (sinusoidally) corrugated paper. The corrugated paper 70, and any packaging material made therefrom, does not require a subsequent or separate compression process to achieve the improved cushioning properties.

It will be understood that other embodiments, having different forms of irregular corrugations, can also be developed to provide the required cushioning properties.

It has been found that the packaging material is particularly effective for light but bulky products, having a low static loading upon the packaging material. In one example, a packaging material comprising twenty four layers of corrugated paper was fully compressed, i.e. all of the corrugations were deformed to a flat condition throughout the material; the resilience of the material caused it to spring back to a thickness of approximately 45 mm, and the material was then found to provide maximum cushioning protection in a 300 mm drop for a static loading of between 0.015 $kg/cm^2$ and 0.03 $kg/cm^2$.

Furthermore, tests have suggested that if a product is to be subjected to "normal" transit conditions (i.e. to mail order drop test specifications or general materials handling specifications), a packaging material 40 mm thick (comprising twenty layers of corrugated paper, which material has been fully compressed) will be required to provide sufficient cushioning. Clearly, however, where the conditions of use can be better controlled, the thickness required may be less than 40 mm.

I claim:

1. A method of making a packaging material comprising the steps of (i) forming a sheet of corrugated paper having sinusoidal corrugations, (ii) deforming at least some of the corrugations to destroy their sinusoidal form, (iii) applying adhesive to apices of the corrugations of the sheet of corrugated paper; (iv) winding the sheet into a roll to form a multi-layer material; (v) pressing the roll of material into a shaped material condition; and (vi) permitting the adhesive to set whereby to retain the material in the said shaped condition.

2. The method according to claim 1 further comprising an additional step of cutting a section of the shaped material into a packaging block.

3. The method according to claim 1 further comprising an additional step of adhering a planar sheet of paper to the sheet of paper having sinusoidal corrugations prior to the step of deforming at least some of the corrugations.

4. A method of making a packaging material comprising the steps of (i) forming a sheet of corrugated paper having sinusoidal corrugations, (ii) applying adhesive to apices of the corrugations of the sheet of corrugated paper; (iii) winding the sheet into a roll to form a multi-layer material; (iv) pressing the roll of material into a shaped material condition; (v) permitting the adhesive to set whereby to retain the material in the said shaped condition; and (vi) passing the shaped material through a press whereby to deform at least some of the corrugations to destroy their sinusoidal form.

5. The method according to claim 4 in which at least one paper-engagement face of the press is non-planar.

6. The method according to claim 4 comprising an additional step of cutting a section of the shaped material into a packaging block.

7. A method of making a packaging material, comprising the steps of (i) forming a sheet of corrugated paper having corrugations of a pre-shouldered form, (ii) applying adhesive to apices of the corrugations of the sheet of corrugated paper; (iii) winding the sheet into a roll to form a multi-layer material; (iv) pressing the roll of material into a shaped material condition; and (v) permitting the adhesive to sat whereby to retain the material in the said shaped condition.

8. A method of making a packaging material comprising the steps of (i) securing a sheet of corrugated paper to a sheet of plain paper, (ii) applying adhesive to the exposed apices of the corrugations of the sheet of corrugated paper, (iii) winding the sheet of corrugated paper and the sheet of plain paper into a roll to form a multi-layer material; (iv) pressing the roll of material into a shaped material condition; (v) permitting the adhesive to set whereby to retain the material in the said shaped condition; and (vi) passing the material through a press whereby to deform at least some of the corrugations.

* * * * *